US005291663A

United States Patent [19]

Briglia et al.

[11] Patent Number: 5,291,663

[45] Date of Patent: Mar. 8, 1994

[54] TRIM MARKING TOOL

[76] Inventors: Frank Briglia, 26 Sheldon St., Waterbury, Conn. 06705; James Rioux, 310 East Rd., Bristol, Conn. 06010

[21] Appl. No.: 949,966

[22] Filed: Sep. 24, 1992

[51] Int. Cl.[5] ..... B25H 7/02

[52] U.S. Cl. ..... 33/669; 33/577; 33/578; 33/613

[58] Field of Search ..... 33/669, 679, 574, 577, 33/578, 562, 613

[56] References Cited

U.S. PATENT DOCUMENTS

| | | | |
|---|---|---|---|
| 719,516 | 2/1903 | Schmiedl | 33/577 |
| 877,879 | 1/1908 | Ash | 33/669 |
| 1,636,025 | 7/1927 | Waelde | 33/669 |
| 1,668,683 | 5/1928 | Koubek | 33/578 |
| 1,668,684 | 5/1928 | Koubek | 33/578 |
| 2,498,417 | 2/1950 | Haff | 33/623 |
| 2,632,250 | 3/1953 | Rauser | 33/26 |
| 3,331,135 | 7/1967 | Urish | 33/578 X |
| 3,402,474 | 9/1968 | Janeiro | 33/574 |
| 4,519,143 | 5/1985 | Correlli | 33/669 |

*Primary Examiner*—William A. Cuchlinski, Jr.
*Assistant Examiner*—Alvin Wirthlin
*Attorney, Agent, or Firm*—McAulay Fisher Nissen Goldberg & Kiel

[57] ABSTRACT

A trim marking tool is disclosed which utilizes a plurality of pins located in a slot and movable therein such that the pins can be aligned to conform to measurements taken. The pins are locked into position and a sheet material is placed on a base of the tool with an upper member containing the pins then closed on a lower member such that the pins indent the sheet material for indicating that either bending or cutting is required. Once the tool is set for a particular style window or door, marking of numerous pieces of sheet material can proceed without resetting and pieces bent and cut accordingly.

9 Claims, 3 Drawing Sheets

TRIM MARKING TOOL

TECHNICAL FIELD

This invention relates to a marking tool for indicating bend and cut lines on a sheet material.

BACKGROUND

When applying sheet material, for example, to a house which is being sided, special provision must be made for preparing trim pieces for the various window and door openings. Each opening requires custom trimmed pieces which must be cut and bent manually prior to application to the house. Typically, this is the most time consuming aspect of applying siding as the open side areas are easily covered with the standard sheet material. However, when making trim for a window or door opening, a series of measurements are required, which must be transcribed on to opposite ends of a sheet which is then cut and bent to fit in place. This operation is repeated for each side of the opening. Since this is such a time consuming aspect of the job, a tool for improving the ease with which the trim pieces are marked and cut could save substantially in labor costs on any siding installation.

Various devices have been proposed for marking sheet material for bending. For example, in U.S. Pat. No. 1,668,684, a marking tool is described which has a pair of angle iron members, one member having a slot containing pins movable in the slot for marking a sheet placed on the other member.

In U.S. Pat. No. 4,519,143, a sheet metal marking tool has a die carrying rod that pivots relative to a base such that all dies carried simultaneously indent a plurality of marks in a sheet of metal placed on a plywood base.

While such devices have been patented, they have not gained commercial acceptance and the search continues for devices which are simple in construction, reliable in operation and solve the problems encountered by workers in the field. Consequently, the search continues for a tool which allows marking and bending of sheet metal for trim pieces which is simple in construction, reliable in operation and provides substantial reductions in the time required to complete a house siding installation.

SUMMARY OF THE INVENTION

It is an object of the present invention to provide a trim marking tool which quickly provides marks on sheet material to indicate bend and/or cut lines.

It is a further object of the present invention to provide a device which is simple in construction yet which has sufficient weight to avoid distortion during marking.

It is a further object to provide a device which is reliable in use.

These and other objects of the present invention are achieved by providing a trim marking tool for marking a sheet material comprising a base, means for locating the sheet material on the base, a channel located in the base and extending along one side thereof, an upper member attached by a hinge to the base and having socket means for aligning with the locating means on the base. A slot, located in the upper member, has a length complimentary to the length of the sheet material and is located such that when the upper and lower members are engaged, the slot is directly over the channel. A plurality of marking pins are slidably disposed in the slot, the pins having indicating means alignable with measuring means disposed on a top surface of the upper member. Each pin has either a pointed or planar end for indicating a bend line or cut line for marking on the sheet material. A handle is attached to a front portion of the upper member for closing the tool and forcing the indicating means into the sheet material.

Optionally, the channel has a resilient strip located therein for absorbing the impact of the pin end. Preferably, the alignment means are upwardly extending pins which extend from the base and provide side and end stops for the sheet disposed on the tool. Sockets in the upper member align with and are engaged by the pins to assure alignment between the upper and lower members. The tool base should be somewhat heavy and rigid and may include passages through which screws are used to attach the base to a work surface such as a work table. Having the tool remain rigid during use prevents movement which may cause misalignment during marking.

Utilizing the tool of the invention, marks can be made quickly and reliable in a sheet material as the pins designating cut lines and pins designating bend lines are readily arranged within the slot. Once the pins are set for a particular style of trim, a plurality of trim pieces can accurately be marked for bending and cutting without remeasuring each door or window. Thus, a substantial amount of time can be saved when adding siding to a house.

BRIEF DESCRIPTIONS OF THE DRAWINGS

Figure 3:
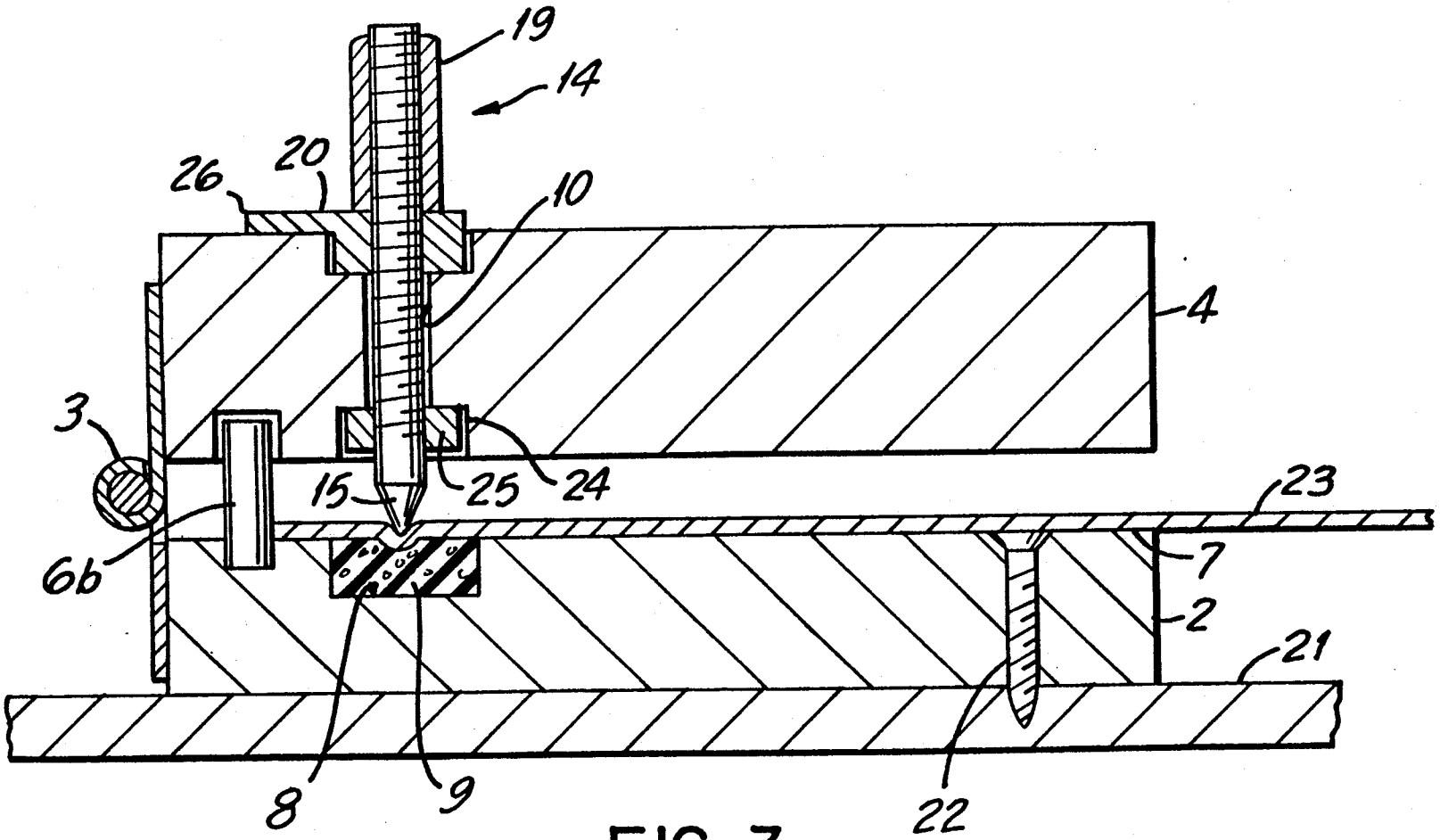
FIG. 3 is a cross-sectional view showing the marking of a sheet material in the tool.
Figure 5A:
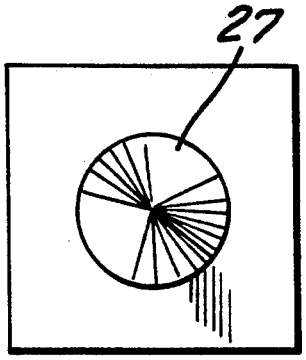
Figure 5B:
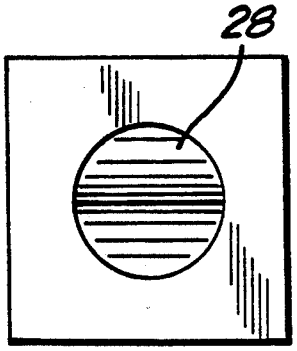

FIG. 5*a* is a view taken along line 5—5 of FIG. 3; FIG. 5*b* is an alternative embodiment of the pin end showing a cut mark as opposed to a bend mark.

Figure 6:
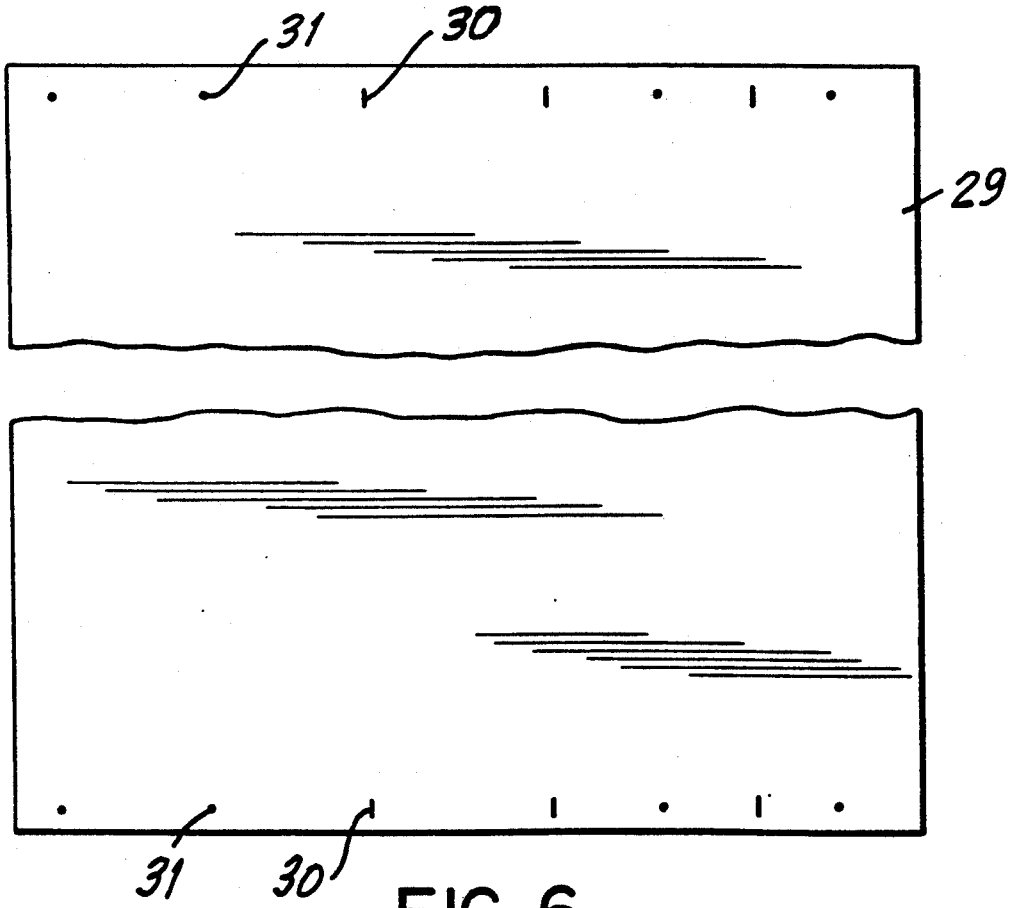

FIG. 6 shows a sheet material having marks on opposite ends thereof.

DETAILED DESCRIPTION OF THE INVENTION

Figure 1:
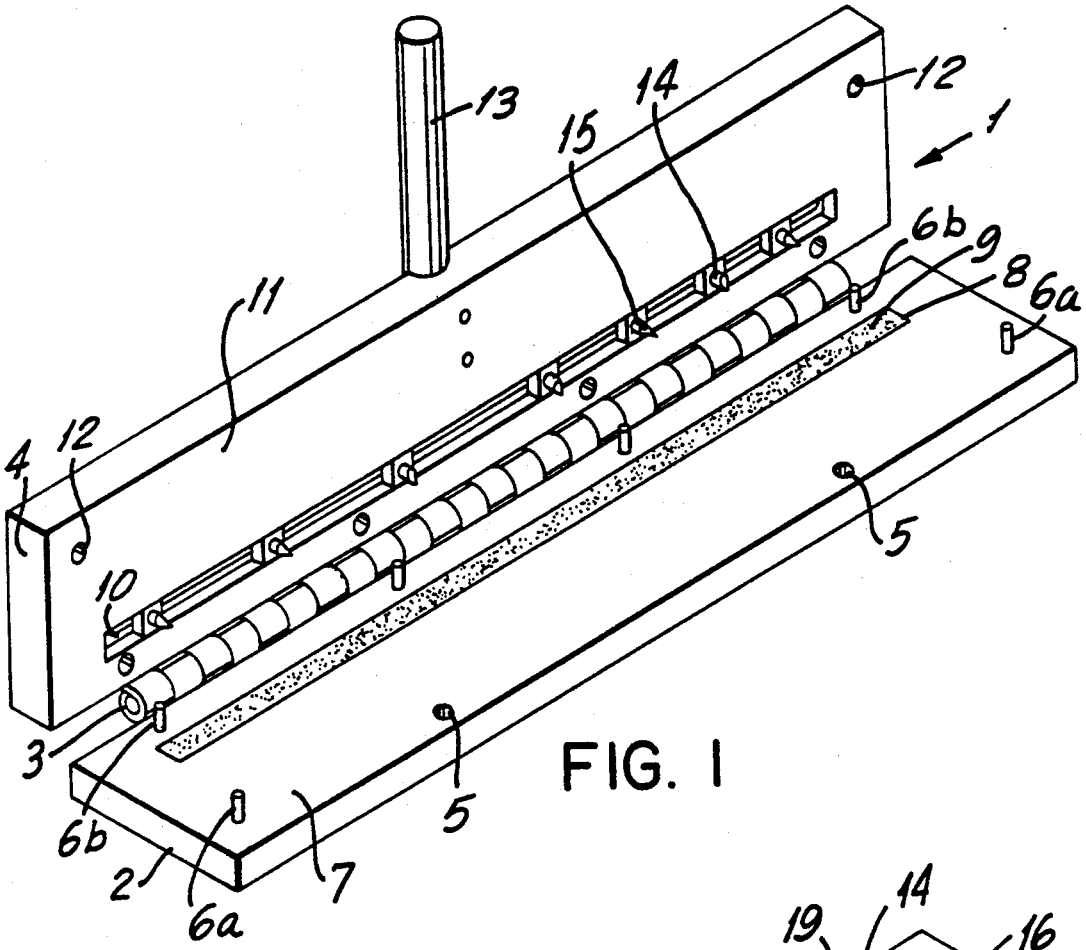
FIG. 1 is a perspective view of the trim marking tool of the invention shown in the open condition.

Referring to FIG. 1, a trim marking tool 1 has a base 2 connected by a hinge 3 to an upper planar member 4. The base 2 has through holes 5 for temporally fixing the base to a work surface such as a wooden work table. A plurality of pins 6 extend upwardly from a top surface 7 of the base which assures alignment of a sheet material on the base. Two side alignment pins 6*a* work in conjunction with four end pins 6*b* to assure proper alignment of the sheet material. Typically, the side alignment pins are spaced at a distance of about 24" which is the common width of siding material. Of course, the tool can be designed for accommodating wider material.

The base has a channel 8 located adjacent to an end thereof which has a length complementary to the sheet material width. In this case, the channel has a length of approximately 24". A resilient strip 9 is located within the channel to support the sheet material when placed thereover. The resilient material absorbs the impact of marking pins used to mark the sheet and to prevent dulling of the indicator portion of the pins.

The upper member 4 is rotatable about the hinge 3. The member 4 has a slot 10 therethrough which is alignable with the channel 8 in the base when the member and base are in contact. The slot 10 has a length similar to the length of the sheet material, in this case, about 24". A bottom surface 11 of the member has a plurality of sockets 12 which accept the alignment pins therein. This assures proper mating of the member and the base during marking. A handle 13 extends from the upper member for manually opening and closing the tool. A plurality of marking pins 14 are slidably disposed within the slot. Each pin has a marking end 15 which extends from the bottom surface of the member.

Figure 2:
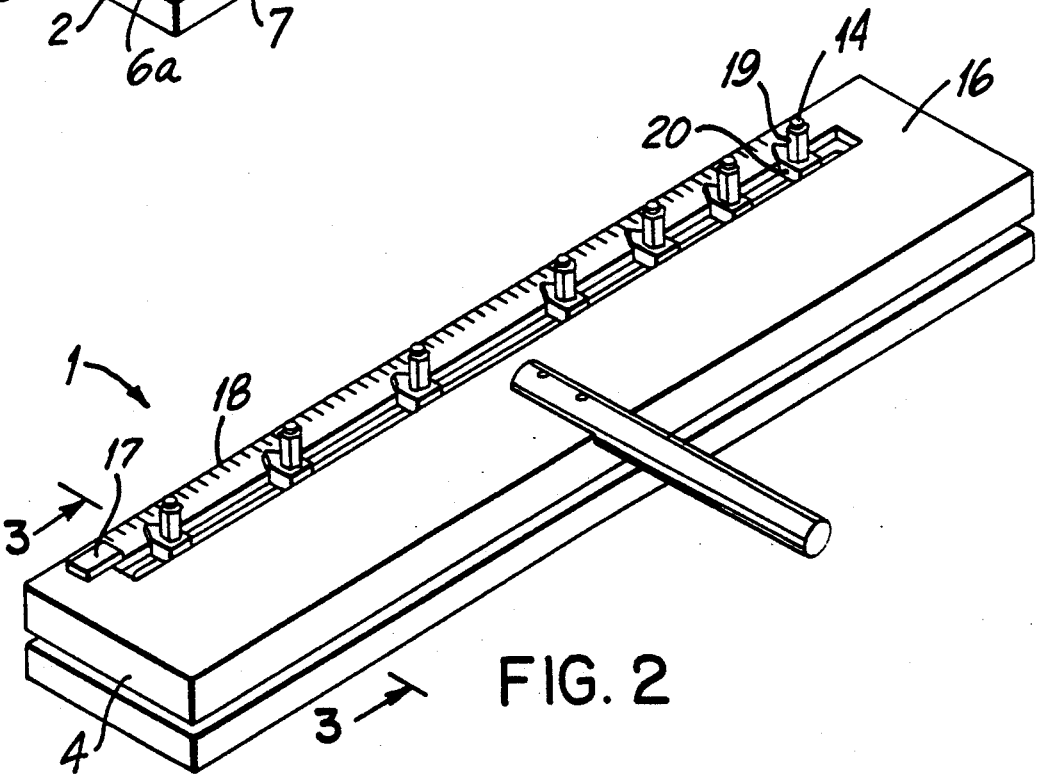
FIG. 2 is a perspective view of the tool of FIG. 1 shown in the closed position.

Referring to FIG. 2, the tool 1 is shown in the closed position. The member 4 has an upper surface 16 with an edge stop 17 which is aligned with the side alignment pins 6*a* to assure coordination of the upper and lower measurements. A manual rule 18 is located by etching along the edge of the member, beginning at the stop. Alternatively, a separate rule maybe fixed to the upper surface adjacent the slot. Each pin 14 has a locking nut 19 and an indicating portion 20 alignable with the rule. Thus, the pins slide within the slot to any desired position and then are locked in place.

Referring to FIG. 3, the base 2 is attached to a work surface 21 by a screw 22. A sheet material 23 is located on the top surface 7 of the base and is abutted against the pin 6*b*. The upper member 4 is attached to the lower member by the hinge 3. The slot 10 has a stepped portion 24 within which a square or rectangular portion 25 of the pin is slidable. This portion assures that the pin is inserted in the proper orientation such that it cannot be rotated.

Figure 4:
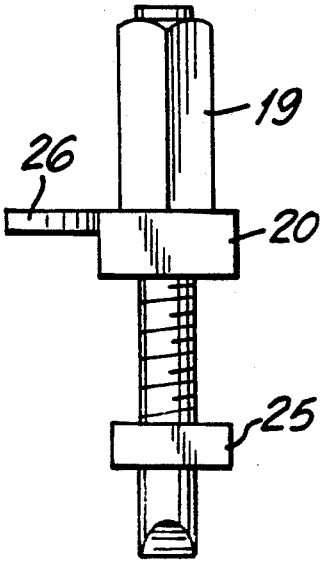
FIG. 4 is an enlarged view of a marking pin.

The channel 8 has a resilient material 9 disposed therein. The pin 14 is disposed within the slot with the pin locking nut 19 engaging the indication portion 20 which has a pointer 26. The pointer is disposed over the rule to provide an indication of the position of the pin relative to the underlying sheet material. FIG. 4 is another view of a marking pin.

When the nut is loosened, the pin may slide within the slot with the rectangular locating portion preventing rotation of the pin. When moved to the proper location, the locking nut is turned to lock the pin in position for marking. When in that condition, the marking end 15 of the pin extends below the bottom surface of the upper member such that it will at least minimally enter into the channel 8 containing the resilient strip 9. Any sheet material disposed therebetween will be indented with a mark corresponding to the end 15, as shown.

In operation, the upper member 4 is in an upward position and the sheet material 23 is placed on the base 2. The marking pins are located at the proper spacing for marking the sheet for cuts and bends and are locked in position. The upper member is then forced onto the base thus marking the sheet material.

FIG. 5*a* shows a typical bend marking tip 27 which may provide a point indication on the sheet material. Thus, the pin makes a circular indentation on the sheet material. FIG. 5*b* shows a cut marking tip 28 which has a planar edge end which makes an indented line mark on the sheet material. FIG. 6 shows a sheet material 29 with cut markings 30 and bend markings 31 thereon. When the material 29 is marked with lines, the operator knows that in those areas a cut must be made while in the areas of the circular indentation, a bend must be made. Once set for a particular style of trim, rapid marking of the trim pieces on opposite ends and forming can be achieved without remeasuring for every door or window opening. Consequently, utilizing the tool of the invention provides for rapid trim production with consequent savings in labor costs.

While preferred embodiments of the present invention has been shown and described, it will be understood by those skilled in the art that various changes or modifications could be made without varying from the scope of the present invention.

We claim:

1. A marking tool for marking a sheet material comprising a base, a channel located in the base and extending along a first side thereof, an upper member attached by a hinge to the base, the hinge extending at least partially along the first side thereof, a pair of side alignment means disposed adjacent each end edge of the channel and a plurality of end alignment means disposed between the channel and the hinge, a slot located in the upper member adjacent the channel and having a length complimentary to the length of the channel, a plurality of marking pins slidably disposed in the slot, the pins having indicating means alignable with rule means disposed on a top surface of the upper member, each pin having marking means which indent the sheet material to indicate whether a cut or bend is required in the sheet material and handle means for closing the tool, the side alignment means located adjacent the channel to produce marks at an edge of the sheet material when placed in the tool.

2. The tool of claim 1 further comprising a resilient strip disposed within the channel.

3. The tool of claim 1 wherein each pin comprises a cylindrical member having a stepped portion at a lower end thereof, for preventing rotation of the pin within the slot.

4. The tool of claim 3 wherein the cylindrical member is threaded and each pin has a movable threaded nut on an upper end thereof.

5. The tool of claim 1 wherein the base further comprises passages for receiving means for attaching the base to a work surface.

6. The tool of claim 1 wherein the side and end alignment means comprise a plurality of upwardly extending pins for locating the sheet material on the base, a plurality of sockets provided in the upper member for receiving the pins when the tool is closed.

7. The tool of claim 1 wherein the side alignment means are disposed at a spacing of about 24 inches.

8. The tool of claim 1 wherein one or more pins has a pointed marking end for forming an indented dot on the sheet material for indicating a bend line.

9. The tool of claim 1 wherein one or more pins has a planar edge end for forming an indented line on the sheet material for indicating a cutting line.

* * * * *